US006846045B2

(12) United States Patent
Sollami

(10) Patent No.: US 6,846,045 B2
(45) **Date of Patent: *Jan. 25, 2005**

(54) REVERSE TAPER CUTTING TIP WITH A COLLAR

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/409,892

(22) Filed: Apr. 9, 2003

(65) Prior Publication Data

US 2003/0193235 A1 Oct. 16, 2003

Related U.S. Application Data

(60) Provisional application No. 60/372,063, filed on Apr. 12, 2002.

(51) Int. Cl.[7] ..... E21C 35/17

(52) U.S. Cl. ..... 299/105; 299/111; 299/113

(58) Field of Search ..... 299/105, 111, 299/113

(56) References Cited

U.S. PATENT DOCUMENTS 5,702,160 A * 12/1997 Levankovskii et al. ..... 299/111
5,873,423 A * 2/1999 Briese ..... 299/111
2003/0052530 A1 * 3/2003 Sollami ..... 299/111

* cited by examiner

*Primary Examiner*—John Kreck
(74) *Attorney, Agent, or Firm*—Robert L. Marsh

(57) ABSTRACT

A cutting tool has tool body with a seat at a forward end thereof. A hard cutting insert is bonded into the seat. The insert is made of a hard material and Ahas an elongate central portion having a maximum upper diameter and a maximum lower diameter that is less than the maximum upper diameter. A collar, also made of a hard material, surrounds the base of the elongate central portion of the insert.

6 Claims, 1 Drawing Sheet

REVERSE TAPER CUTTING TIP WITH A COLLAR

The applicant claims priority from his provisional application filed Apr. 12, 2002 and assigned Ser. No. 60/372,063 now abandoned.

The present application relates to the cutting tips at the forward end of tools used to break up hard surfaces such as concrete and asphalt and, in particular, to an improved multi-element cutting insert at the forward end of such tools that offers, among other benefits, more protection to the tool body against wash away.

BACKGROUND OF THE INVENTION

Machines used to break up concrete and asphalt pavement and other hard surfaces have a plurality of tools mounted on a cutting wheel which is forced against the surface to be broken. Each tool has an elongate steel body at the forward end of which is a tungsten carbide cutting tip. When the wheel rotates, the tools are carried through a circular orbit and the tungsten carbide tips penetrate the hard surface with each tip removing a small amount of material, thereby advancing the cut.

The tools suffer wear as a result of being moved against the hard material being cut and have to be replaced at regular intervals. Each time the tools are replaced, the machine is taken out of service for a lengthy period of time. Machines used to break up concrete and asphalt roadways are kept in continuous operation through the work day except for when the tools are being replaced, and it is not uncommon to replace the tools in such machines two or three times during a work day. The frequency with which tools have to be replaced and the time consumed during the replacement process therefore reduce the efficiency of the machine and increase the cost of its operation.

The cost of replacement tools and the efficiency with which the tools cut the hard abrasive material also effect the economic efficiency of the machine. To minimize tool costs it desirable that the components of the tool, namely the tool body and the tungsten carbide cutting tip, have comparable endurance to wear. The energy needed to operate the machines, and therefor the cost of operation, increases if the cutting tips become too blunt before the tool body has become sufficiently worn to require replacement. Both the cost of the tool and the cutting efficiency of the tool are important factors in maximizing the efficiency of the tools.

Tool failure can occur as a result of the failure the braze material holding the tungsten carbide tip into the seat at the forward end of the tool body. To prevent failure of the braze and the dislodging of the insert, the hardened inserts of such tools should have a base diameter of at least 0.700 inches.

Theoretically, the life of the cutting insert will be increased by providing a larger sized insert, however enlarging all diameters of a currently available one piece tungsten carbide cutting tip will reduce the efficiency of the machine because the tip will rapidly become blunt. Since the tungsten carbide is the most expensive element in the tool, increasing the size of the insert will also increase tool cost. On the other hand, the metal which makes up the tool bodies is subject to wash away causing the tool to fail as aggregate of the hard material cut by the machine erodes away the metal of the tool body behind the tungsten carbide tip.

It has long been recognized that the useful life of a tool can be substantially extended by increasing the hardness of the tungsten carbide from which the cutting inserts are made. Efforts to make a tool having a harder insert, however, have not been successful partly because harder grades of tungsten carbide are more brittle and tend to fracture, and partly because the harder grades of tungsten carbide are more difficult to manufacture. A harder insert is manufactured by using particles of tungsten carbide and cobalt and having smaller grain sizes of tungsten carbide with a higher concentration of tungsten carbide and a corresponding lower concentration of cobalt. It is the cobalt which cements sintered tungsten carbide together and to compensate for the reduction of cobalt in the product the particles must be more uniformly compacted together prior to sintering to reduce the intergranular porosity. If the particles are not uniformly compacted the completed insert will have less dense areas, or porosity, and be subject to failure.

One effort to provide an insert which is made of a harder grade which is less subject to fracture is depicted in FIGS. 15–17 of U.S. Pat. No. 5,551,760 to Sollami. The insert depicted in Sollami has a cylindrical core and surrounding the core is an annular collar made of a softer grade of tungsten carbide. The core and the collar are bonded together with braze material. One difficulty with the Sollami insert has been the difficulty of properly assembling the parts of the insert and maintaining the part in their correct relationship during the brazing process. Specifically, the weight of the tungsten carbide collar is insufficient to push the collar through the liquefied braze material until it seats properly at the bottom of the seat. The proper seating of the collar therefore requires at least one more step in the manufacturing process. It would be desirable, therefore, to provide an improved two piece insert consisting of a hard elongate core and a softer annular collar in which the parts would fit together as a unit so as become properly seated during the brazing operation.

BRIEF DESCRIPTION OF THE INVENTION

Briefly, the present invention is embodied in a cutting tool for a cutting machine where the tool has a body with a longitudinal axis, a tapered cutting portion symmetric about the axis, a radial flange axially behind the forward cutting portion and a cylindrical shank axially behind the radial flange. The tool body has a seat at the forward end of the cutting portion, and the seat has a generally cylindrical inner wall with a given diameter into which a tungsten carbide insert is brazed.

In accordance with the invention the hardened insert is made of two components which are assembled in coaxial relationship to each other and are inserted into the seat of the forward end of the body. The seat consists of an axial bore into the forward end of the tapered cutting portion of the body. The central portion of the seat has a frustoconical outer wall and a conical bottom with the outer circumference of the conical bottom joining the lower end of the frustoconical bore. At the mouth of the central portion is an enlarged annular countersink portion with a cylindrical walls and a generally planar shoulder connecting the cylindrical wall of the countersink portion to the forward most end of the frustoconical wall of the central portion.

Fitted within the seat is a hardened insert made of two components assembled in coaxial relationship. The central component has a generally conical forward end having a maximum first diameter and a conical rearward end having a maximum second diameter, the second diameter being less than the first diameter. Extending between the forward end and the rearward end is a frustoconical midsection with the large diameter of the midsection being congruent with the maximum first diameter of the forward end and the small diameter of the mid-section being congruent with the maximum second diameter of the rearward end. The smaller rearward end of the central component is received in the central portion of the seat with the rearward surface thereof engaging the conical bottom of the seat.

A tungsten carbide annular collar is provided having an inner diameter which is less than the first diameter of the central portion and greater than the second diameter thereof, and an outer diameter which is a little less than the diameter of the cylindrical inner wall of the countersink portion of the seat. To assemble the parts together a disk of braze is fitted on the bottom of the seat portion of the countersink and a ring a braze is fitted on the shoulder between the frustoconical wall of the central portion and the cylindrical wall of the countersink. The small diameter rearward end of the central component of the insert is inserted through the central opening of the collar, then the central component with the collar assembled thereto is inserted into the seat with the rearward end of the central portion of the insert extending toward the bottom of the seat. The cylindrical outer wall of the collar is fitted within the cylindrical inner wall of the countersink of the seat as the insert is assembled into the seat. A flux is applied to the parts which protects the braze by preventing oxidation from forming on the carbide and steel surfaces to be brazed. The parts are heated causing the braze material to melt. The tool body is orientated with the tapered cutting end extending upwardly such that gravity will draw the parts together. The reverse taper of the central component will engage the inner wall of the collar and the weight of the central component will draw the collar downwardly into the countersink as the braze melts. Once the insert is properly seated the parts are allowed to cool after which the components will be securely bound together.

In the preferred embodiment the collar is made of softer grade of tungsten carbide than the central portion thereof such that the collar will assist in retaining the central portion to the forward end of the tool and will absorb some of the shock incurred to the head of the tool as it cuts hard surfaces and thereby reduce the potential for breakage of the tungsten carbide insert from the tool body. The relatively large diameter of the insert, including the outer diameter of the collar, provides protection to the forward end of the body of the tool thereby extending the useful life of the tool.

BRIEF DESCRIPTION OF THE DRAWINGS

A better and more complete understanding of the invention can be had after a reading of the following detailed description taken in junction with the drawings wherein.

DETAILED DESCRIPTION OF THE PREFERRED EMBODIMENT

Figure 1:
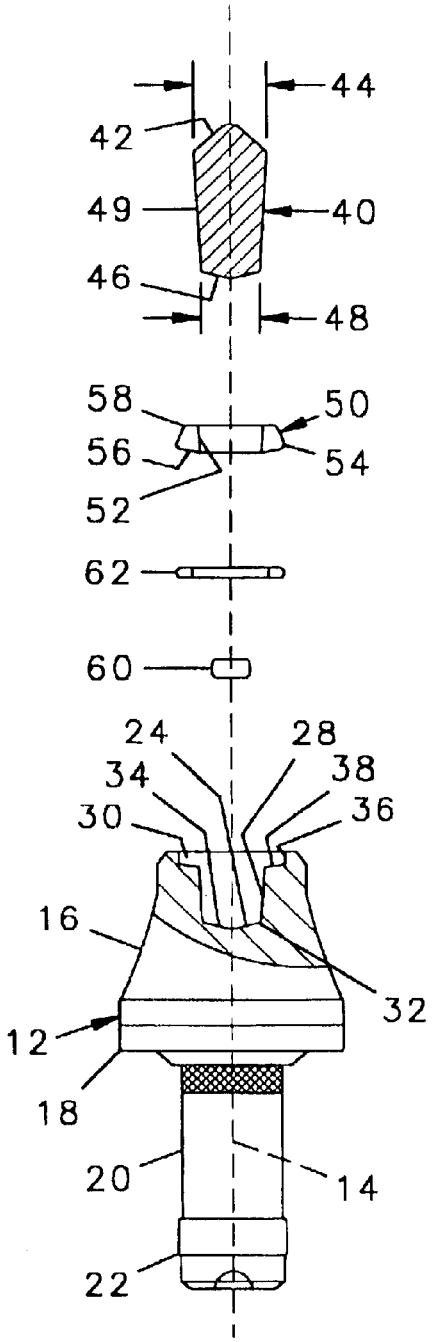
FIG. 1 is an exploded partially cross sectional plan view of a tool consisting of a tool body and an insert in accordance with the present invention.
Figure 2:
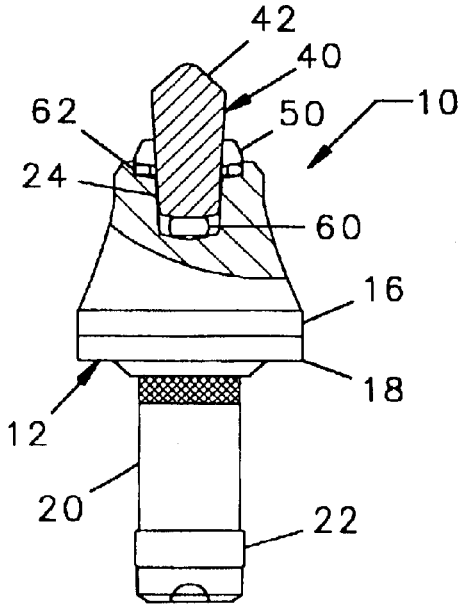
FIG. 2 is another partially cross sectional plan view of the tool and insert shown in FIG. 1 with the components of the insert assembled to the tool body prior to the melting of the braze material.
Figure 3:
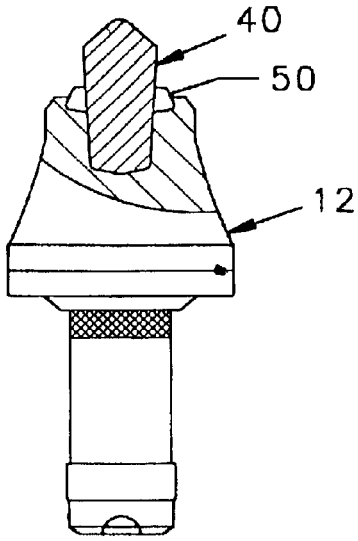
FIG. 3 is a third partially cross sectional plan view of the fully manufactured tool shown in FIG. 1.

Referring to FIGS. 1, 2 and 3, a tool 10 has an elongated body 12 symmetrical about its longitudinal axis 14. The tool includes a tapered forward section 16, at the rearward end of which is a radial flange 18. Extending axially rearward of the flange 18 is a cylindrical shank 20 at the distal end of which is a cylindrical hub 22. At the forward end of the forward section 16 is a seat 24 into which is brazed a cutting insert 26.

In accordance with the invention the seat 24 has a frustoconical central portion 28 with a large diameter forward end 30 and a smaller diameter lower end 32. At the bottom of the central portion 28 is a conical floor 34. Extending around the large diameter forward end 30 is a countersink portion consisting of a cylindrical inner wall 36 having a diameter considerably larger than that of the large diameter forward end 30, and a generally planer annular shoulder 38 between the rearward end of the cylindrical wall 36 and the large diameter forward end 30 of the frustoconical central portion 28.

The insert 26 consists of a central component 40 having a conical forward end 42 with a maximum first diameter 44 and a conical rearward end 46 with a maximum second diameter 48. The central component 40 further includes a frustoconical midsection 49 tapering inwardly from the maximum first diameter 44 down to the maximum second diameter 48.

Fitted around the central component 40 is a annular collar 50 having an inner diameter 52 which is larger than the maximum second diameter 48 and less than the maximum first diameter 44, and approximately midway between those two dimensions. The collar 50 further has a cylindrical outer wall 54 which is a little less than the cylindrical inner wall 36 of the countersink portion 38 of the seat 24. The collar 50 further has an annular rear surface 56 complementary in shape to the annual shoulder 38 of the seat 24. Finally, the collar 50 has an annular forward surface 58 extending from the inner diameter 52 outward to the outer wall 54.

To assemble the parts the tool body 12 is orientated with the seat 24 directed upwardly and the shank 20 directed downwardly as shown in the Figures. A disk of brazed material 60 is placed on the conical floor 34 and a ring of brazed material 62 is inserted on the shoulder 38. The rearward end 46 of the central component 40 of the insert 26 is inserted through the central opening of the collar 50 and into the frustoconical central portion 28 of the seat 24.

In the preferred embodiment the frustoconical wall 49 of the central component 40 of insert 26 will engage with the inner diameter 52 of the collar 50 when the parts are in the proper alignment for fitting into the seat 24. As the parts are heated and the braze material 60, 62 is caused to melt, the engagement between the inner wall 52 of the collar 50 and the frustoconical midsection 49 of the central component 40 will keep the parts in their desired orientation as the braze melts. The weight of the central component 40 will further be added to the weight of the collar 50 and will pull the collar 50 downward into the cylindrical inner wall 36 of the countersink portion of the seat 24.

The weight of the tungsten carbide parts and the engagement of the inner wall of the collar and outer wall of the central portion will keep the parts in their desired orientation as the braze material melts, causing them to drop to the bottom of their respective seats. The parts are then physically pressed into place and allowed to cool after which they will be brazed together in the configuration shown in FIG. 3.

In the preferred embodiment the central component 40 is made of a harder blend of tungsten carbide than is the tungsten carbide used to make the annular collar 50. Accordingly the softer collar 50 will absorb some of the shock incurred during the use of the tool and thereby provide more shock absorbing ability to resist breakage of either the central component 40 or of the collar 50 as it is used to cut a hard surface. Also, the outer diameter of the collar 50, which may be greater than the outer diameter of prior art inserts such that the tungsten carbide of the central component 40 and of the collar 50 provide a shield to the tapered forward portion 16 of the tool body 12. Where the central component 40 is made with an extended length, both the extended length of the central component and the shielding effect of the insert will combine to extend the useful life of the tool 10.

Accordingly, there is shown in a cutting tool with an improved insert which provides for a shield to the tool body and has a longer useful life because of the harder structure of the central portion thereof.

While the present invention has been described with respect to a single embodiment it will be appreciated that there are many modifications and variations which fall within the true spirit and scope of the invention. It is therefore the intent of the following claims to cover all such variations and modifications which fall within this sprit and scope of the invention.

What is claimed:

1. A cutting tool comprising a tool body having a longitudinal axis, a tapered cutting portion symmetrical about said axis, a radial flange axially behind said tapered cutting portion and a cylindrical shank axially behind said radial flange, said tool body having a seat at a forward end of said cutting portion, said seat having a given maximum outer diameter, an insert bonded into said seat, said insert comprising a central portion made of a hardened material and having a tapered forward cutting end diverging to a maximum first diameter, a rearward end having a maximum second diameter, said first diameter larger than said second diameter, and an elongate midsection extending from said first diameter to said second diameter, an annular collar also made of said hardened material, said annular collar having a central aperture for receiving said midsection of said insert, and an outer diameter sized to fit within said given maximum outer diameter of said seat.

2. A cutting tool in accordance with claim 1 wherein said midsection of said central portion tapers inwardly from said maximum first diameter to said second diameter.

3. A cutting tool tool in accordance with claim 1 wherein said central portion and said annular collar are made of tungsten carbide.

4. A cutting tool in accordance with claim 1 wherein said central portion of said insert has a different hardness than said annular collar.

5. A cutting tool in accordance with claim 4 wherein said central portion is harder than said annular collar.

6. A cutting tool in accordance with claim 1 wherein said central portion and said collar of said insert are brazed into said seat.

* * * * *